US008813711B2

(12) United States Patent
Valencia et al.

(10) Patent No.: US 8,813,711 B2
(45) Date of Patent: Aug. 26, 2014

(54) CYLINDER HEAD ASSEMBLY HAVING A DRAINAGE PASSAGE

(75) Inventors: Frank Acierno Valencia, Canton, MI (US); John Carl Lohr, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 291 days.

(21) Appl. No.: 13/356,865

(22) Filed: Jan. 24, 2012

(65) Prior Publication Data

US 2013/0186364 A1 Jul. 25, 2013

(51) Int. Cl.
*F01L 1/26* (2006.01)

(52) U.S. Cl.
USPC ..... 123/193.5; 123/90.27

(58) Field of Classification Search
USPC ..... 123/193.5, 90.27
See application file for complete search history.

(56) References Cited

U.S. PATENT DOCUMENTS

| | | | | |
|---|---|---|---|---|
| 4,938,182 | A * | 7/1990 | Shiozawa | 123/193.5 |
| 5,054,457 | A | 10/1991 | Sakamoto | |
| 5,081,960 | A | 1/1992 | Shimamoto | |
| 5,398,649 | A | 3/1995 | Shimamoto | |
| 6,062,928 | A | 5/2000 | Watanabe et al. | |
| 6,945,211 | B2 * | 9/2005 | Nagahashi et al. | 123/193.5 |
| 6,982,379 | B2 | 1/2006 | Saka et al. | |
| 7,765,986 | B2 | 8/2010 | Cho et al. | |
| 2001/0012740 | A1 | 8/2001 | Kitsu et al. | |
| 2010/0122861 | A1 | 5/2010 | Padilla et al. | |

* cited by examiner

*Primary Examiner* — M. McMahon
(74) *Attorney, Agent, or Firm* — Greg Brown; Alleman Hall McCoy Russell & Tuttle LLP

(57) ABSTRACT

A cylinder head assembly is provided. In one example, the cylinder head assembly includes a cylinder head, a cam cap coupled to the cylinder head having a component port, and a cam cover coupled to the cylinder head. The cylinder head assembly cylinder head assembly further includes a drainage passage including an inlet opening and an outlet extending through an exterior cylinder head surface.

19 Claims, 9 Drawing Sheets

CYLINDER HEAD ASSEMBLY HAVING A DRAINAGE PASSAGE

BACKGROUND/SUMMARY

An engine may include recesses to enable easy access to components and for maintenance purposes. The recesses may enable a desired area within the engine to be sealed while at the same time providing an entry port for a component such as a valve. Moreover, engine covers and other external engine components may be formed with indentations or recesses for other reasons such as reducing the profile of the engine.

However, water may form in the aforementioned recesses and indentations due to condensation as well as exposure to the external environment. For example, a valve recess in a cam cover may collect water during engine operation due to condensation or other environmental factors. The pooled water may corrode external surfaces of the valve and the cam cover. Moreover, when the valve is removed for maintenance and servicing water and particulates in the water may flow into the sealed chamber. As a result, the operation of components within the enclosure, such as the cam shaft, cam bearing, cam lobes, etc., may be degraded due to contamination. Furthermore, if the engine experiences temperatures below freezing, the pooled water may freeze and consequently expand, damaging the components in the recess.

As such in one approach a cylinder head assembly is provided. The cylinder head assembly includes a cylinder head, a cam cap coupled to the cylinder head having a component port, and a cam cover coupled to the cylinder head and configured to seal a cam enclosure. The cylinder head assembly further includes a recess extending into the cam cover and configured to receive a component and a drainage passage including an inlet opening into the recess and an outlet extending through an exterior cylinder head surface.

In this way, drainage is provided to the recess, enabling water and other contaminates to be flowed to the exterior of the engine. Consequently, component degradation caused by corrosion, freezing, and servicing contamination may be avoided.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 2-8 are drawn to scale.

DETAILED DESCRIPTION

A cylinder head assembly having a drainage passage is described herein. The drainage passage enables water and other contaminates to be flowed away from a recess where water may collect. The recess may be included in a cam cover for sealing a cam enclosure. The recess enables components, such as solenoid valves, to be positioned in the cylinder head assembly while keeping the cam enclosure sealed. The drainage passage includes an inlet opening into the recess and an outlet opening into an exterior sidewall of the cylinder head. In this way, a drain is provided to the recess, reducing the likelihood of degradation of the components in the recess from corrosion, freezing, etc. Additionally, the drainage passage may be internally routed through the cam cap and the cylinder head, thereby increasing the compactness of the cylinder head assembly and decreasing assembly costs.

Figure 1:
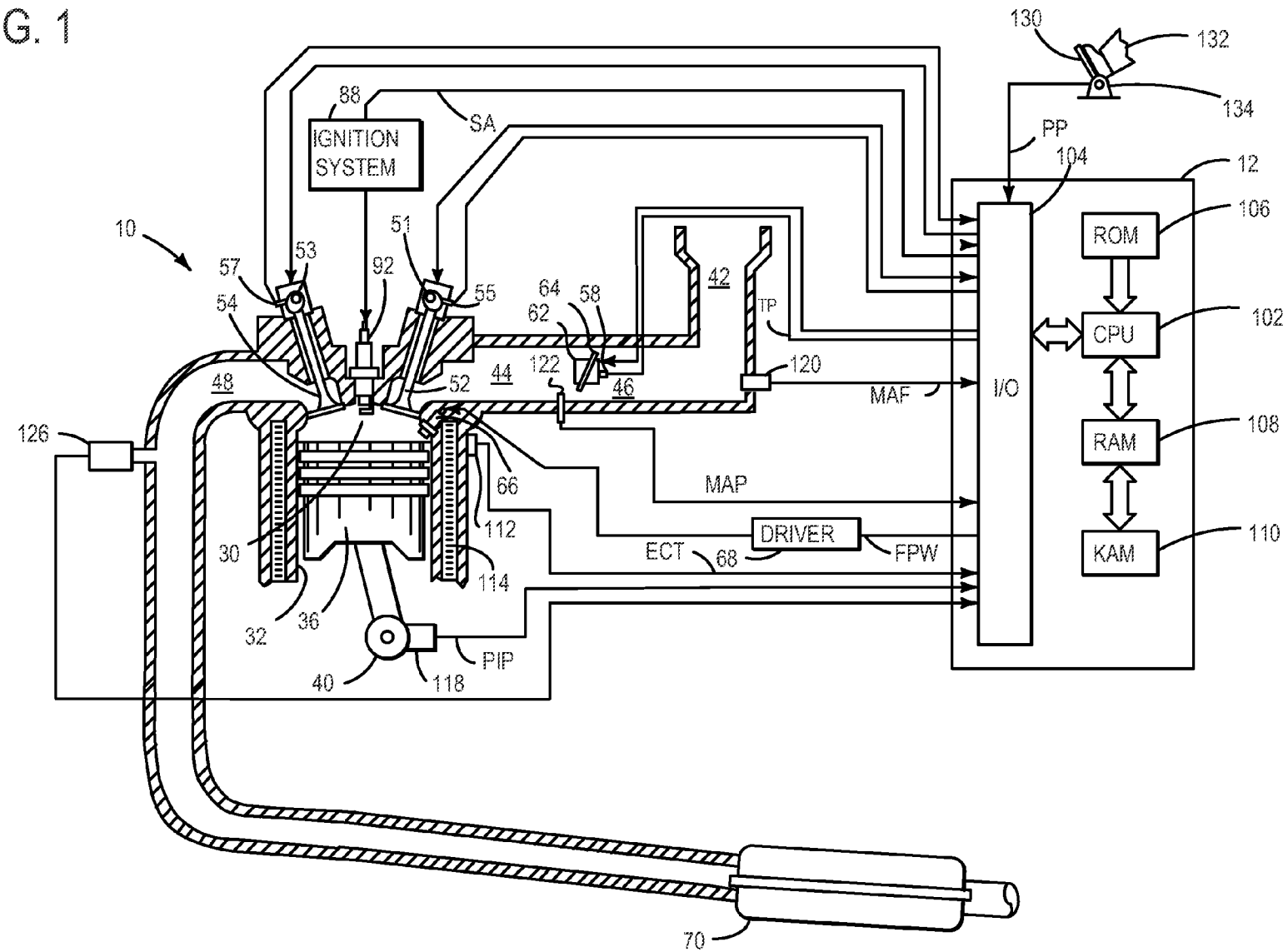
FIG. 1 shows a schematic depiction of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to a crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively or additionally, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into combustion chamber 30, which is known to those skilled in the art as direct injection. Alternatively or additionally, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46. In other examples, the engine 10 may include a turbocharger having a compressor positioned in the intake system and a turbine positioned in the exhaust system. The turbine may be coupled to the compressor via a shaft. A high pressure, dual stage, fuel system may be used to generate higher fuel pressures at injectors 66.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Figure 2:
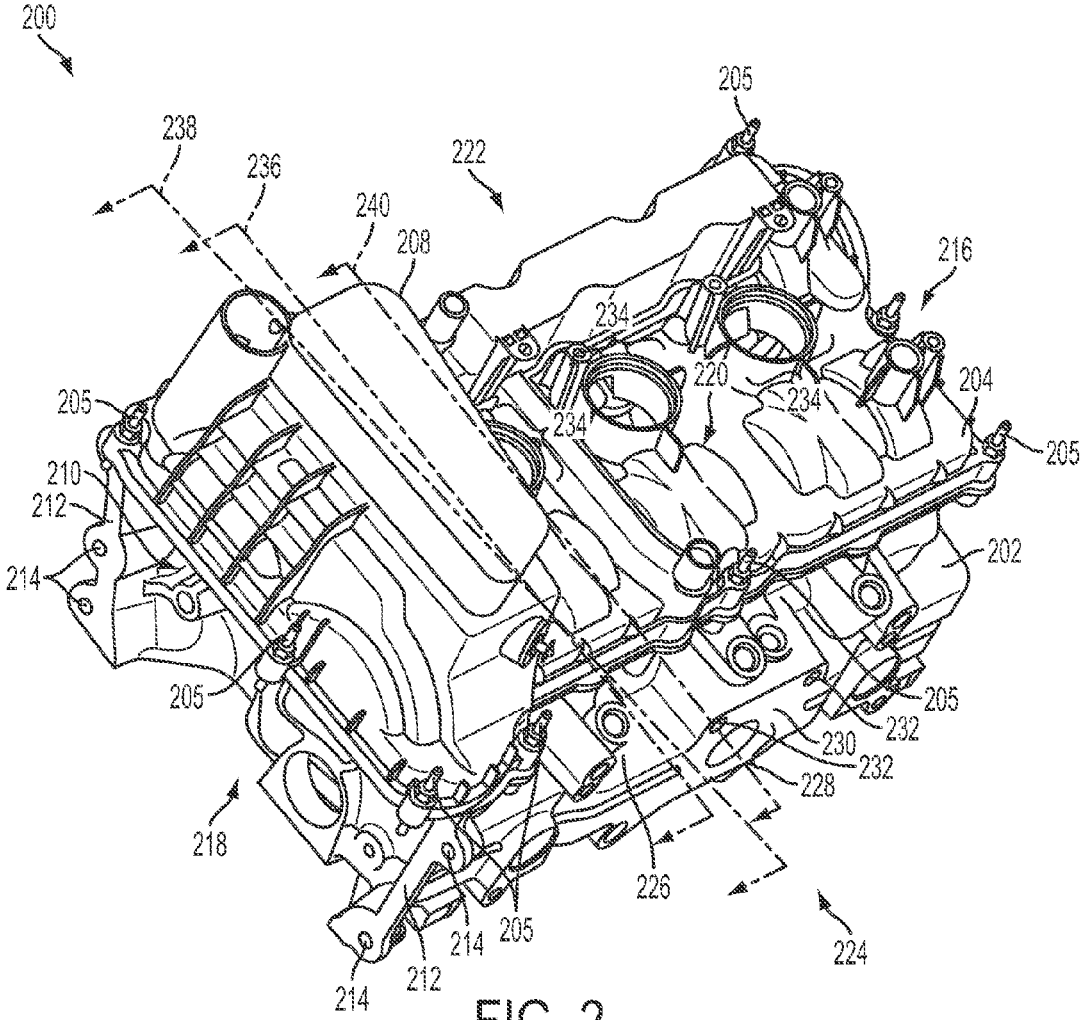
FIG. 2 shows an illustration of a cylinder head assembly.

FIG. 2 shows an example cylinder head assembly 200 including a cylinder head 202 having cam cover 204 coupled thereto via bolts 205 or other suitable attachment apparatuses. Cylinder head assembly 200 may be included in engine 10. A cam cap 300 may also be coupled to the cylinder head 202, shown in FIG. 3 and discussed in greater detail herein. In the depicted embodiment, bolts 206 are used to attach the cam cover 204 to the cylinder head 202. However, in other examples, other suitable attachment apparatuses may be utilized. The cam cover 204 is configured to seal a cam enclosure 400, shown in FIG. 4. The cam enclosure may be sealed and enclose cam shafts, bearings, cam lobes, etc. A valve cover 208 is also depicted in FIG. 2. The valve cover 208 encloses the solenoid valves (308 and 310), shown in FIG. 3, and is coupled to the cam cover 204. However, in other examples the valve cover 208 may not be included in the cylinder head assembly 200.

The cylinder head assembly 200 further includes a front side 210 including a front engine cover engaging surface 212. The front engine cover engaging surface 212 is configured to couple to a front engine cover (not shown). Openings 214 configured to receive attachment devices, such as bolts, included in the front engine cover engaging surface 212, may be used to attach the front engine cover to the front engine cover engaging surface 212. However, in other examples other suitable techniques may be used to attach the front engine cover to the front engine cover engaging surface 212.

Figure 5:
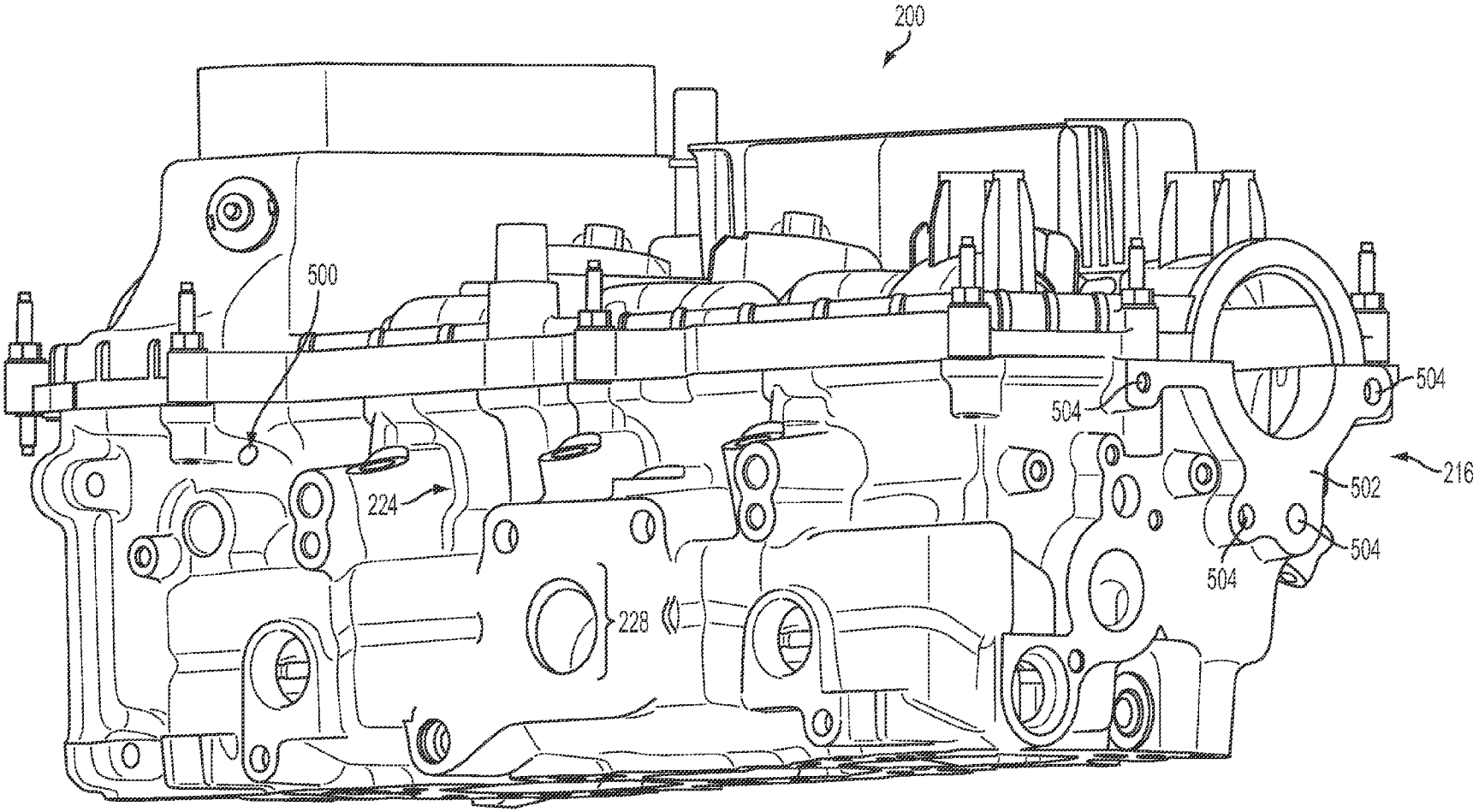
FIGS. 5-6 show alternate views of the cylinder head assembly shown in FIG. 2.

The cylinder head assembly 200 further includes a rear side 216 including a transmission bell housing engaging surface 502, shown in FIG. 5. The transmission bell housing engaging surface 502 is configured to attach to a transmission bell housing. The cylinder head 202 also include a bottom side 218 configured to couple to a cylinder block (not shown) and a top side 220. The cylinder head 202 may include a portion of a least one combustion chamber. It will be appreciated that a combustion chamber may be formed when the cylinder head 202 is coupled to the cylinder block.

Continuing with FIG. 2, the cylinder head assembly 200 further includes an intake side 222 and an exhaust side 224. The exhaust side 224 includes an exterior sidewall 226 of the cylinder head 202 and an exhaust manifold outlet 228. The cylinder head assembly 200 further includes an exhaust manifold flange 230 having openings 232. Components such as an exhaust passage, a turbine, etc., may be attached to the exhaust manifold flange 230 via the openings 232. In this way, downstream components may be in fluidic communication with the exhaust manifold outlet 228.

Figure 4:
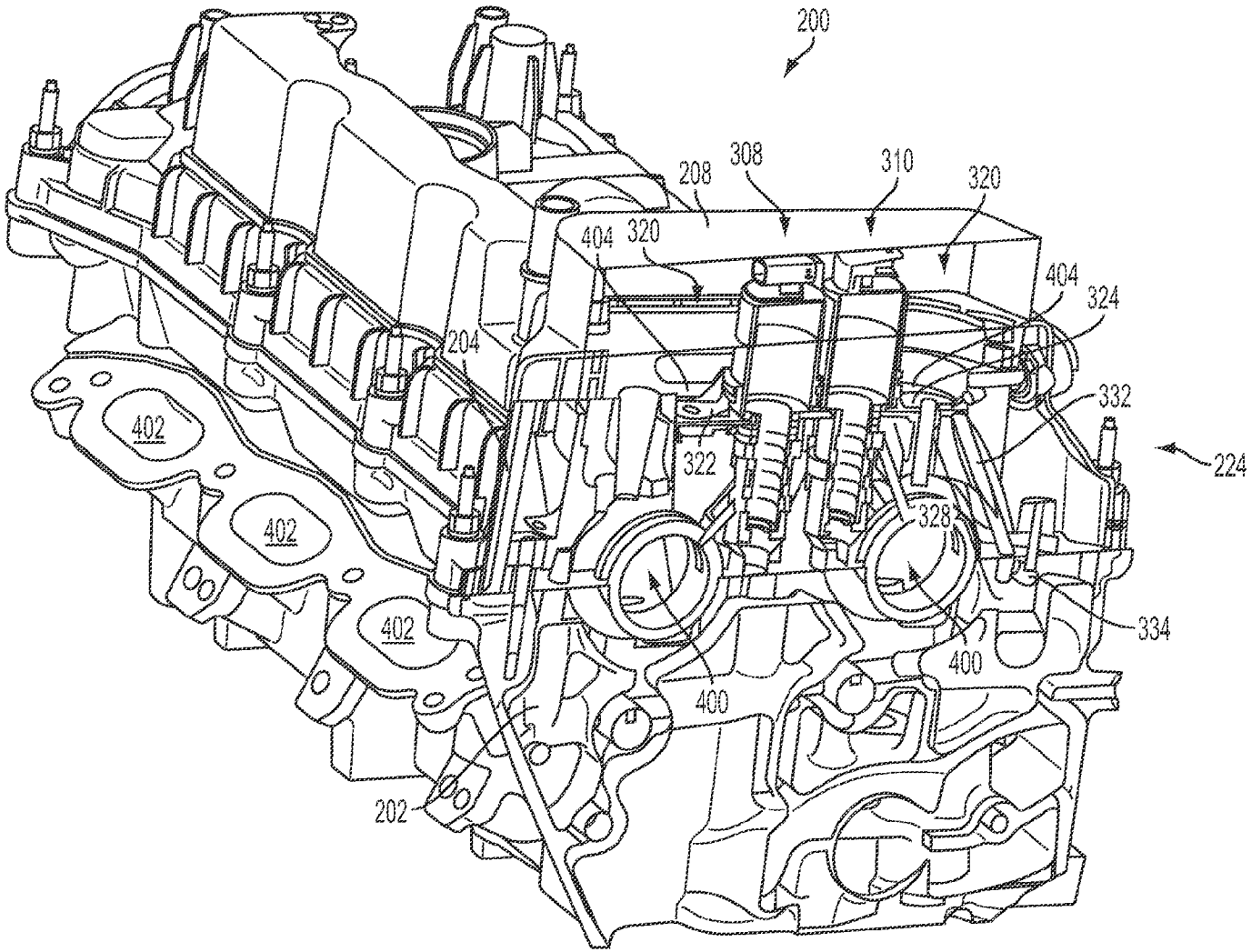
FIG. 4 shows another cross-sectional view of the cylinder head assembly shown in FIG. 2.

On the other hand, the intake side 222 includes intake runners or air inlet ports 402, shown in FIG. 4. Continuing with FIG. 2, the cam cover 204 includes ignition device ports 234 configured to receive ignition devices, such as spark plugs. As shown, three ignition device ports 234 corresponding to three separate combustion chambers, are shown. However, engine assemblies having an alternate number of ignition device ports and/or combustion chambers have been contemplated.

Although a single cylinder head 202 is shown in FIG. 2, it will be appreciated that the cylinder head assembly 200 may include a second cylinder head 202 and second cam cover 204 having a similar geometry and functionality to the cylinder head 202 and cam cover 204. It will be appreciated that the second cylinder head 202 may be included in a second cylinder bank arranged at a non-straight angle with regard to the first cylinder bank in which the cylinder head 202 is included. Thus, the cylinder head assembly 200 may have a V-configuration. Cutting plane 236 defines the cross-section shown in FIG. 3. Additionally, cutting plane 238 defines the cross-section shown in FIG. 4. Cutting plane 240 defines the cross-section shown in FIG. 8.

Figure 3:
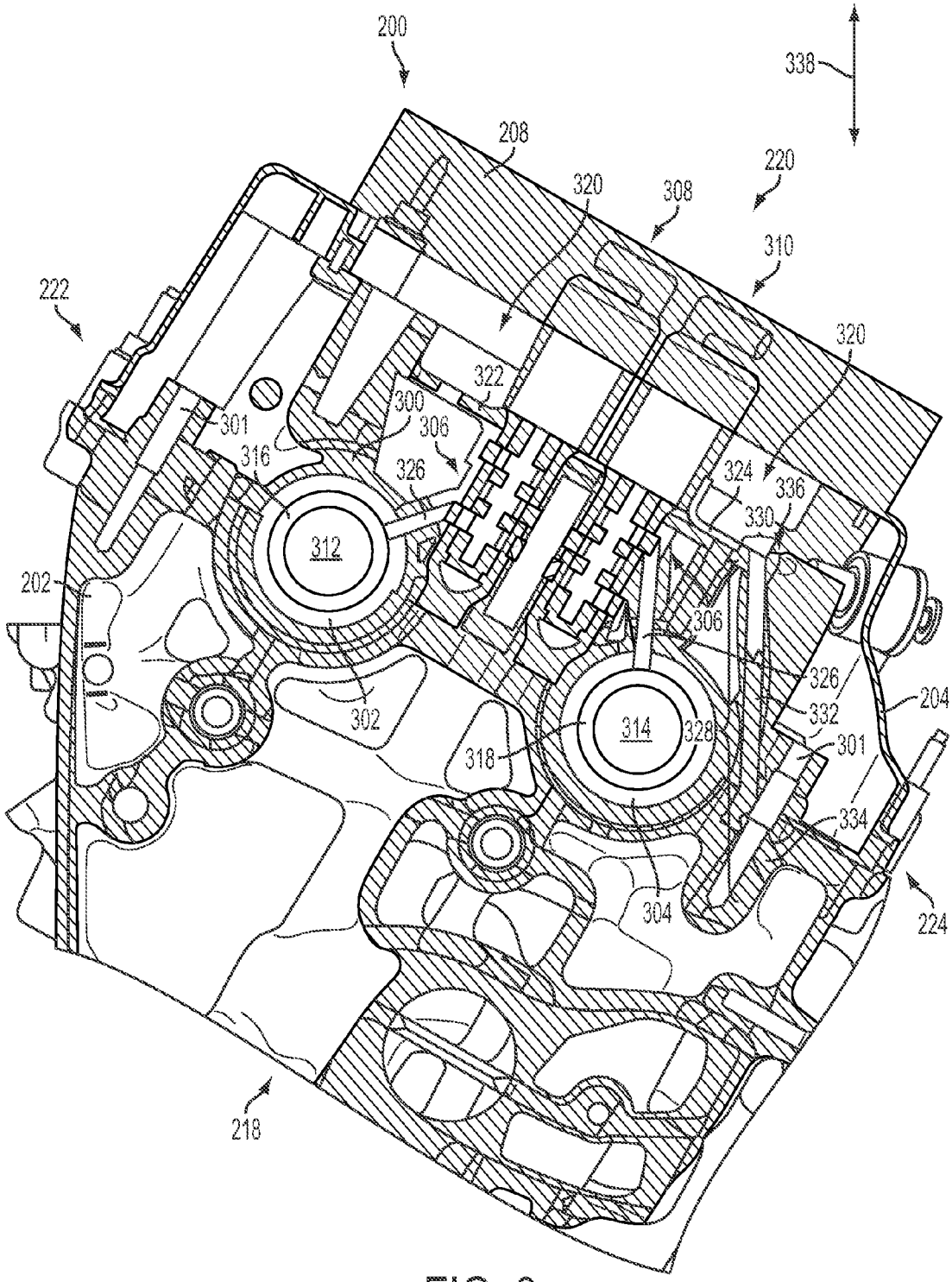
FIG. 3 shows a cross-sectional view of the cylinder head assembly shown in FIG. 2.

FIG. 3 shows a cross-sectional view of the cylinder head assembly 200 shown in FIG. 2. The cylinder head 202 and the cam cover 204 are shown. Additionally, the bottom side 218, the top side 220, the intake side 222, and the exhaust side 224 of the cylinder head assembly 200 are also shown.

The cylinder head assembly 200 also includes a cam cap 300. The cam cap 300 is coupled to the cylinder head 202 via bolts 301 or other suitable attachment apparatuses. A sealant may also be used to attach the cylinder head 202 to the cam cap 300. The cam cap 300 and the cylinder head 202 form an intake bearing cap 302 and an exhaust bearing cap 304. The cam cap may further include component ports 306 configured to receive a first solenoid valve 308 and a second solenoid valve 310. The component ports 306 are solenoid valve ports in the depicted embodiment. However, the component ports 306 may receive other components in other examples. The first solenoid valve 308 is configured to adjust the timing of an intake cam-shaft 312. Likewise, the second solenoid valve 310 is configured to adjust the timing of an exhaust cam-shaft 314. The intake cam-shaft 312 and the exhaust cam-shaft 314 may be configured to cyclically actuate intake and exhaust valves for combustion chambers in the cylinder head assembly 200. For example, each cam shaft may include lobes configured to cyclically actuate valves (e.g., intake or exhaust valves). An intake cam bearing 316 positioned in the intake bearing cap 302 is configured to enable rotation of the intake cam-shaft 312. Likewise, an exhaust cam bearing 318 positioned in the exhaust bearing cap 304 is configured to enable rotation of the exhaust cam-shaft 314.

The first solenoid valve 308 and the second solenoid valve 310 are positioned in a recess 320 of the cam cover 204. The recess 320 enables the solenoid valves (308 and 310) to be inserted into the cam cap 300.

The first solenoid valve 308 includes a first attachment flange 322. The second solenoid valve 310 also includes a second attachment flange 324. The first attachment flange 322 and the second attachment flange 324 are configured to attach to a surface 404 of the recess 320, shown in FIG. 4. Therefore, the surface 404 may be configured to engage the solenoid valves (308 and 310) and is discussed in greater detail herein.

Oil may be routed to the first and second solenoid valves (308 and 310) so that the solenoid valves can control valve timing via oil flow. Oil supply passages 326 are in fluidic communication with the first and second solenoid valves (308 and 310) and configured to supply oil thereto. Oil may also be routed through the bearing caps (302 and 304) to provide lubrication to the cam shaft bearings as well as provide oil to the oil supply passages 326.

The cylinder head assembly 200 further includes a drainage passage 328 including an inlet 330 opening into the recess 320. Furthermore, the drainage passage 328 extends through the cam cap 300 and the cylinder head 202. Specifically, the drainage passage 328 includes a first portion 332 extending through the cam cap 300 and a second portion 334 extending through the cylinder head 202. However, in other examples the cam cap may be integrated into the cylinder head and the drainage passage may include a single portion extending through the cylinder head 202. As shown, the drainage passage 328 extends vertically through both the cam cap 300 and the cylinder head 202. The drainage passage 328 also extends in a lateral direction toward the exhaust side 224 of the cylinder head assembly 200. Thus, the drainage passage 328 is sloped towards the exhaust side 224 of the cylinder head assembly 200 enabling drainage of fluid through the drainage passage 328. Furthermore, the second portion 334 extends through cylinder head 202 and reward toward the transmission bell housing engaging surface 502, shown in FIG. 5. Additionally, the drainage passage 328 is adjacent to the bearing cap 304. However, the drainage passage 328 may have a different orientation in other examples.

The inlet 330 of the drainage passage 328 is positioned near a depression 336 in the recess 320. The depression may include the lowest vertical point in the recess with regard to a gravitational axis 338. In this way, the drainage passage 328 may flow the substantially majority of the water collected in the recess to an external portion of the cylinder head assembly 200, thereby decreasing the possibility of degradation of the solenoid valves (308 and 310) via corrosion and freezing. The gravitational axis 338 is provided for reference. However, it will be appreciated that in other examples the cylinder head assembly 200 may have another orientation with regard to the gravitational axis. Furthermore, the inlet 330 may be positioned in another location in other examples. Moreover, the likelihood of water and other contaminates flowing into the cam enclosure 400, shown in FIG. 4, during servicing of the solenoid valves (308 and 310), is reduced when the drainage passage 328 is utilized. The valve cover 208 is also shown attached to the cam cover 204 in FIG. 3. However, in other examples the valve cover 208 may not be included in the cylinder head assembly 200.

FIG. 4 shows another cross-sectional view of the cylinder head assembly 200 shown in FIG. 2. The bearings (316 and 318) and the cam-shafts (312 and 314) are not shown in FIG. 4 to enable viewing of the cam enclosure 400. As previously discussed, the cam enclosure 400 may house the cam-shafts (312 and 314) as well as other components and may be sealed.

FIG. 4 also shows the drainage passage 328 extending towards the exhaust side 224 of the cylinder head assembly 200. As shown, the first portion 332 of the drainage passage 328 and the second portion 334 of the drainage passage 328 extend in different directions to route the drainage passage 328 around components in the cylinder head assembly 200. In this way, the drainage passage 328 does not interfere with any features of the cylinder head assembly 200. FIG. 4 also shows air intake runners 402 that are in fluidic communication with the combustion chamber in the cylinder head 202. The valve cover 208 is also shown in FIG. 4.

The first attachment flange 322 and the second attachment flange 324 are also depicted. As shown, the first and second attachment flanges (322 and 324) are coupled to a surface 404 of the recess 320. The surface 404 is sloped toward the exhaust side 224 of the cylinder head assembly 200. Bolts or other suitable attachment apparatuses may extend through the flanges into the cam cover 204 to couple the solenoid valves (308 and 310) to the cam cover 204.

FIG. 5 shows another view of the cylinder head assembly 200 including the exhaust side 224 of the cylinder head assembly 200. The exterior sidewall 226 of the cylinder head 202 is depicted. An outlet 500 of the drainage passage 328, shown in FIGS. 3 and 4, is also illustrated. The outlet 500 extends through the exterior sidewall 226. In this way, water can be routed to an exterior of the cylinder head assembly 200 from the recess 320, shown in FIGS. 3 and 4. The outlet 500 is positioned vertically above the exhaust manifold outlet 228. However, in other examples the outlet 500 may be located in another position. FIG. 5 also shows the rear side 216 including the transmission bell housing engaging surface 502. Opening 504 may be included in the transmission bell housing engaging surface 502. As previously discussed, the transmission bell housing engaging surface 502 may be configured to attach to a transmission bell housing (not shown).

Figure 6:
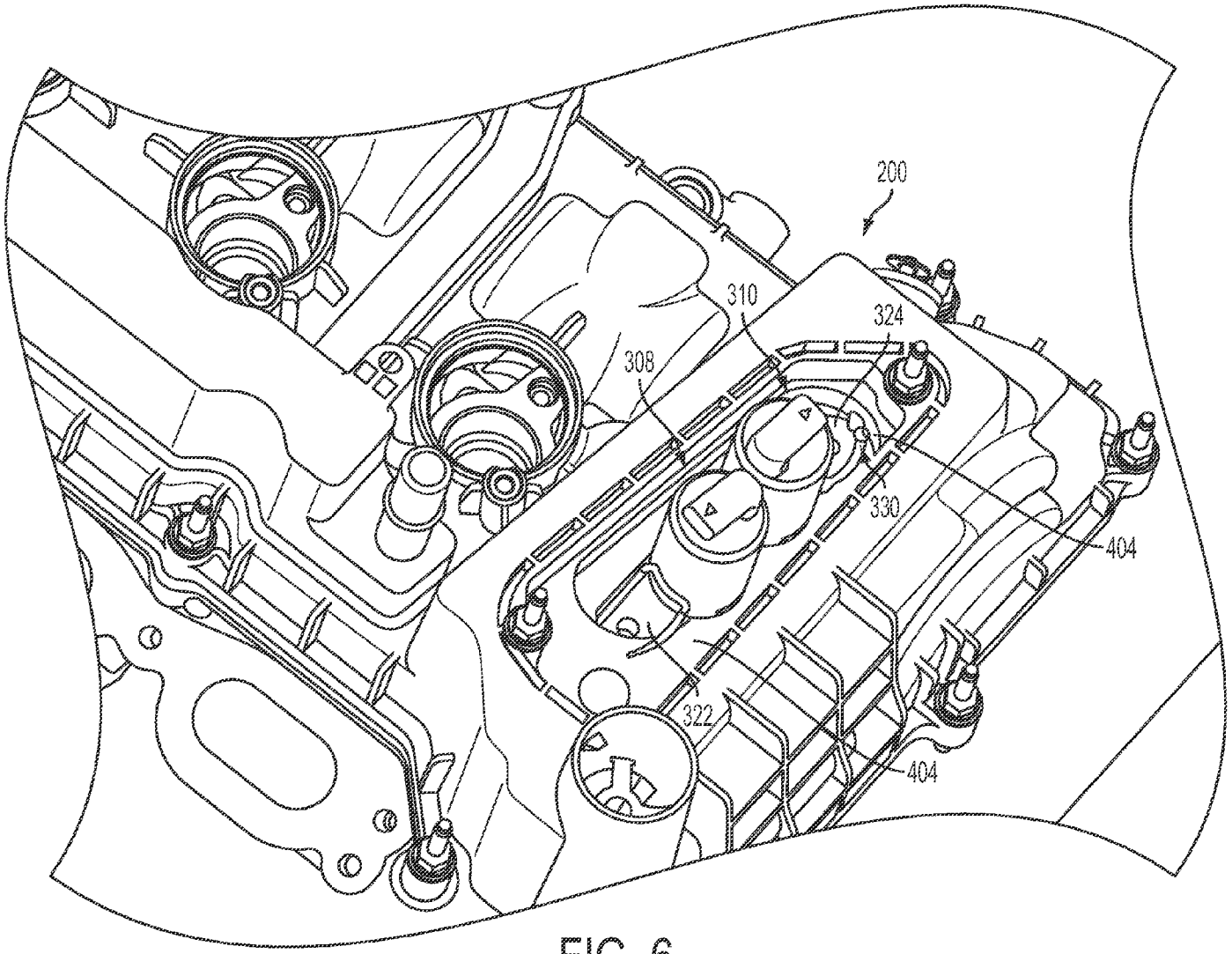

FIG. 6 shows a top view of the cylinder head assembly 200. As shown, the valve cover 208, shown in FIGS. 2, 3, and 4, has been removed to enable viewing the first and second solenoid valves (308 and 310). The first attachment flange 322 and the second attachment flange 324 are also shown. Additionally, the inlet 330 of the drainage passage 328 is shown. The inlet 330 is parallel to the surface 404 of the recess 320, in the depicted embodiment. In this way, water may be flowed into the drainage passage 328, shown in FIGS. 3 and 4. However, in other examples, the inlet 330 may have a different alignment.

Figure 7:
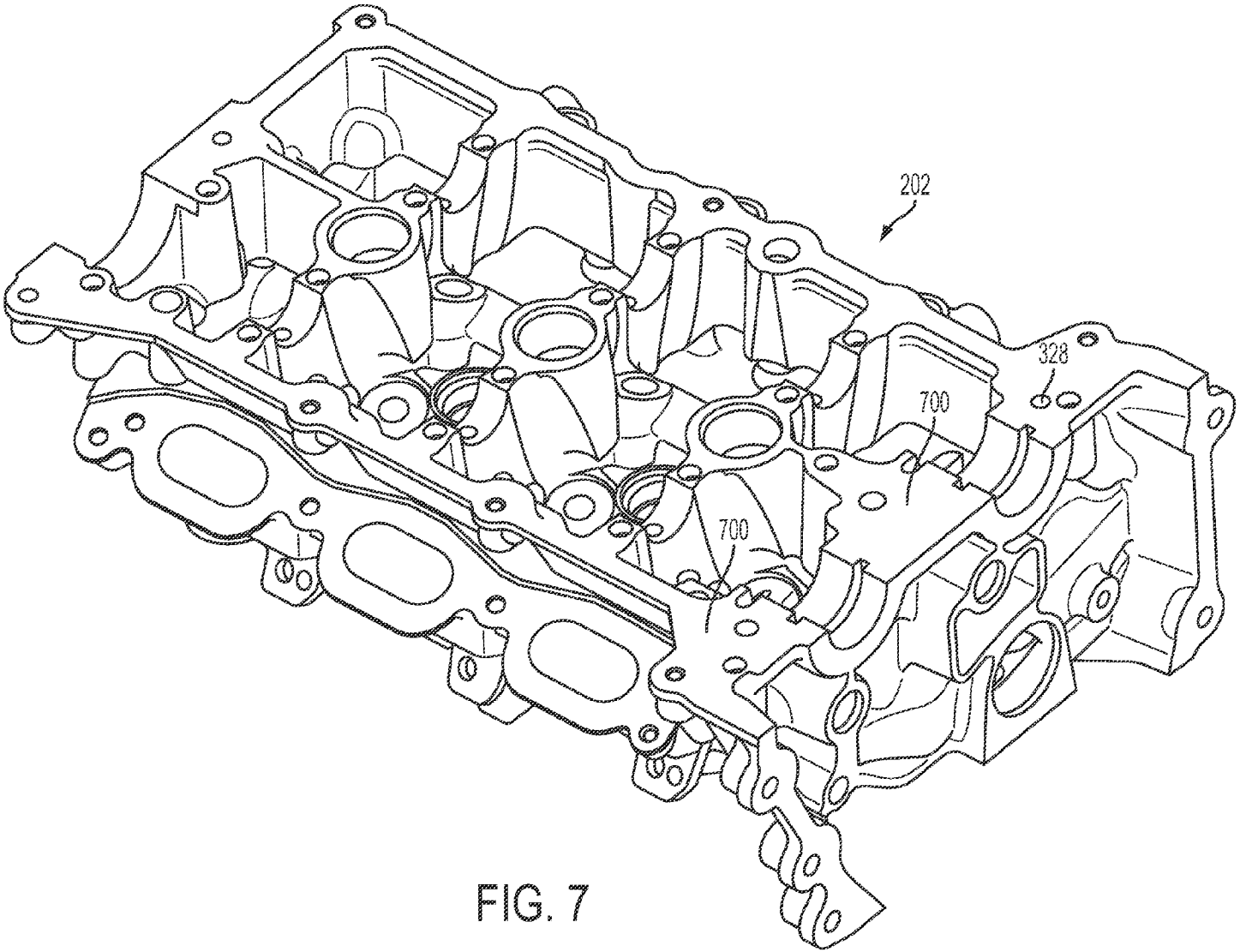
FIG. 7 shows the cylinder head included in the cylinder head assembly shown in FIG. 2.

FIG. 7 shows a view of the cylinder head 202. As shown, the cylinder head 202 includes a cam cap engaging surface 700. The cam cap engaging surface 700 is attaches to the cam cap 300, shown in FIG. 3. An inlet 702 of the second portion 334 of the drainage passage 328, shown in FIGS. 3 and 4, is depicted in FIG. 7. It will be appreciated that the inlet 702 interfaces with an outlet of the first portion 332. In this way, fluid may be flowed from the first portion 332 of the drainage passage 328, shown in FIG. 3, to the second portion 334 of the drainage passage 328.

Figure 8:
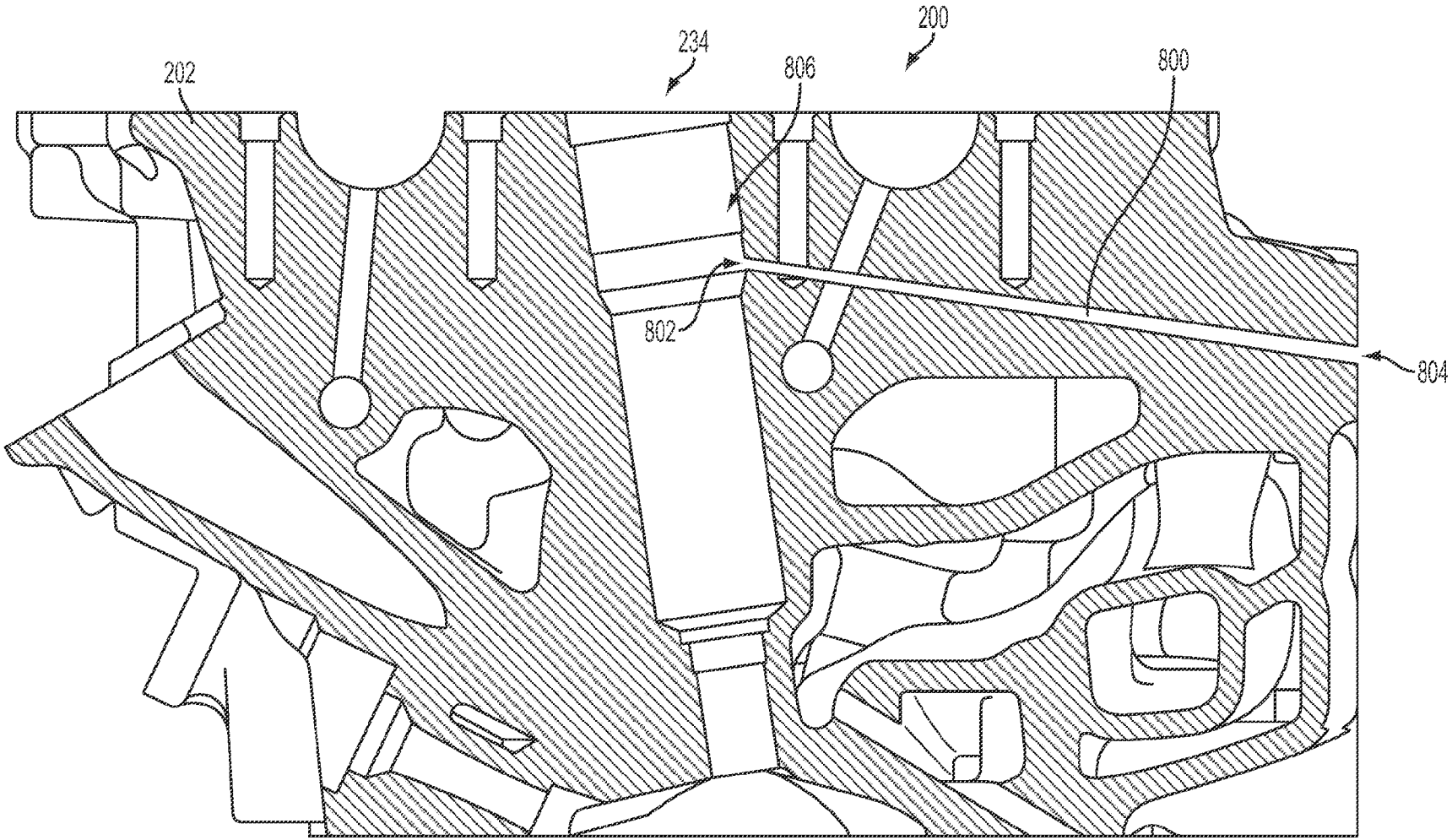
FIG. 8 shows another cross-sectional view of the cylinder head assembly shown in FIG. 2.

FIG. 8 shows a cross-sectional view of the cylinder head assembly 200. A drainage passage 800 extending through the cylinder head 202 having an inlet 802 opening into the ignition device port 234 and an outlet 804 opening to atmosphere exterior to the cylinder head 202. The ignition device port 234 may include a threaded spark plug receiving hole 806. The drainage passage 800 may extend from the ignition device port 234 at a location higher than the threaded spark plug receiving hole 806 to the exterior side of the cylinder head 202. In this way, drainage may be provided to the ignition device port 234. It will be appreciated that additional ignition device ports in the cylinder head assembly 200 may also include drainage passages.

FIGS. 1-8 provide for a cylinder head including a portion of at least one combustion chamber and a drainage passage, the drainage passage including an inlet and an outlet, the outlet opening to atmosphere exterior to the cylinder head. FIGS. 1-8 also provide for a cylinder head assembly where the drainage passage opens to atmosphere via an exterior sidewall of the cylinder head, and where the drainage passage extends towards an exhaust side of the cylinder head assembly. FIGS. 1-8 further provide for a cylinder head assembly where the drainage passage leads to an ignition device port.

FIGS. 1-8 also provide for a cylinder head assembly further comprising a cam cap, and where the drainage passage extends through the cam cap and the cylinder head. FIGS. 1-8 further provide for a cylinder head assembly where the drainage passage extends vertically downward. FIGS. 1-8 further provide for a cylinder head assembly where the drainage passage extends reward toward a transmission bell housing engaging surface included in the cylinder head. FIGS. 1-8 further provide for a cylinder head assembly further comprising a component extending into a component port of the cam cap and a recess of the cam cap.

FIGS. 1-8 also provide for a cylinder head assembly where the component is a solenoid valve that adjusts the timing of a cam-shaft. FIGS. 1-8 further provide for a cylinder head assembly where the cam cap includes a second component port configured to receive a second solenoid valve. FIGS. 1-8 further provide for a cylinder head assembly where the cam cap directs oil to the solenoid valve. FIGS. 1-8 further provide for a cylinder head assembly where the outlet is positioned vertically below an exhaust manifold outlet. FIGS. 1-8 further provide for a cylinder head assembly where the outlet of the drainage passage opens into an exterior sidewall of the cylinder head. FIGS. 1-8 further provide for a cylinder head assembly where the drainage passage is adjacent to a bearing cap.

FIGS. 1-8 also provide for a cylinder head assembly a cylinder head assembly having a cylinder head including a cylinder head drainage passage, the drainage passage including an inlet and an outlet, the outlet opening to atmosphere exterior to the cylinder head and a cam cap coupled to the cylinder head, the cam cap including a component port and a cam cap drainage passage; the cam cap drainage passage in fluidic communication with the cylinder head drainage passage. FIGS. 1-8 also provide for a cylinder head assembly where the component port is a solenoid valve port. FIGS. 1-8 further provide for a cylinder head assembly where the inlet is parallel to a surface configured to engage a solenoid valve. FIGS. 1-8 further provide for a cylinder head assembly where the inlet of the drainage passage is positioned adjacent to a vertical depression in the recess.

FIGS. 1-8 also provide for a cylinder head assembly including a cylinder head, a cam cap coupled to the cylinder head including a solenoid valve port, and a cam cover coupled to the cylinder head and configured to seal a cam enclosure, a recess extending into the cam cover and including a surface sloped towards an exhaust side of the cylinder head assembly, a solenoid valve extending into the recess and the solenoid valve port, and a drainage passage including an inlet opening into the surface and an outlet positioned above an exhaust manifold outlet and extending through an exterior sidewall of the cylinder head, the drainage passage extending vertically downward through the cam cap and the cylinder head.

FIGS. 1-8 also provide for a cylinder head assembly where the exterior sidewall is on an exhaust side of the cylinder head assembly. FIGS. 1-8 further provide for a cylinder head assembly where the inlet of the drainage passage is positioned adjacent to a vertical depression in the recess.

Figure 9:
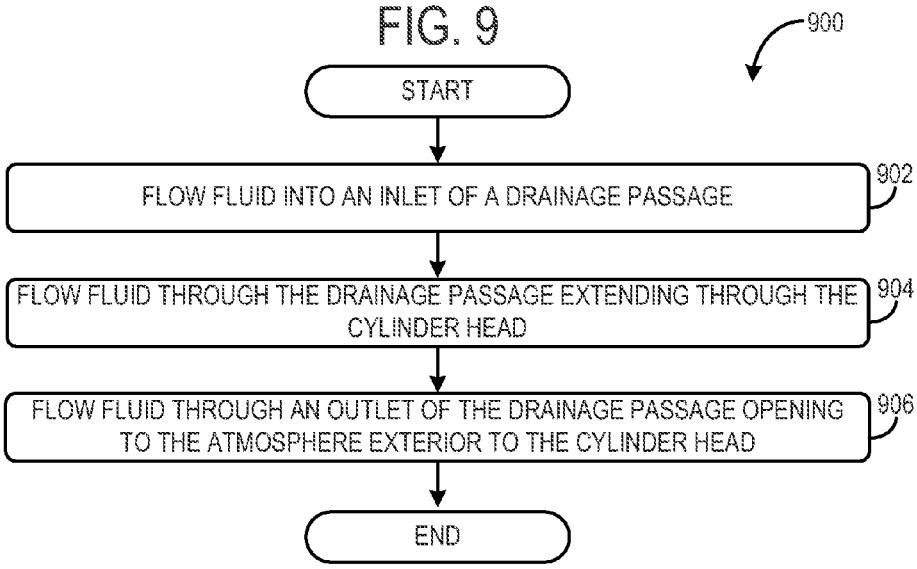
FIG. 9 shows a method for draining fluid from a cylinder head assembly.

FIG. 9 shows a method 900 for draining fluid from a cylinder head assembly. Method 900 may be implemented by the engine and cylinder head assembly described above with regard to FIGS. 1-8 or may be implemented by another suitable engine and cylinder head assembly.

At 902 the method includes flowing fluid into an inlet of a drainage passage. The inlet of the drainage passage may be positioned in a recess of a component port such as a solenoid valve port or a spark plug port.

At 904 the method includes flowing fluid through the drainage passage extending through the cylinder head. Next at 906 the method includes flowing fluid through an outlet of the drainage passage opening to the atmosphere exterior to the cylinder head. This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. A cylinder head, comprising:

a portion of a combustion chamber and a drainage passage, the drainage passage including an inlet and an outlet, the outlet opening to atmosphere exterior to the cylinder head; and a cam cap, the drainage passage extending through the cam cap and the cylinder head.

2. The cylinder head assembly of claim 1, where the drainage passage opens to atmosphere via an exterior sidewall of the cylinder head, and where the drainage passage extends towards an exhaust side of the cylinder head assembly.

3. The cylinder head assembly of claim 1, where the drainage passage leads to an ignition device port.

4. The cylinder head assembly of claim 1, where the drainage passage extends vertically downward.

5. The cylinder head assembly of claim 4, where the drainage passage extends reward toward a transmission bell housing engaging surface included in the cylinder head.

6. The cylinder head assembly of claim 1, further comprising a component extending into a component port of the cam cap and a recess of the cam cap.

7. The cylinder head assembly of claim 6, where the component is a solenoid valve that adjusts a timing of a cam-shaft.

8. The cylinder head assembly of claim 7, where the cam cap includes a second component port configured to receive a second solenoid valve.

9. The cylinder head assembly of claim 7, where the cam cap directs oil to the solenoid valve.

10. The cylinder head assembly of claim 1, where the outlet is positioned vertically above an exhaust manifold outlet.

11. The cylinder head assembly of claim 1, where the outlet of the drainage passage opens into an exterior sidewall of the cylinder head.

12. The cylinder head assembly of claim 1, where the drainage passage is adjacent to a bearing cap.

13. A cylinder head assembly, comprising:

a cylinder head including a cylinder head drainage passage, the drainage passage including an inlet and an outlet, the outlet opening to atmosphere exterior to the cylinder head; and a cam cap coupled to the cylinder head, the cam cap including a component port and a cam cap drainage passage, the cam cap drainage passage in fluidic communication with the cylinder head drainage passage.

14. The cylinder head assembly of claim 13, where the component port is a solenoid valve port.

15. The cylinder head assembly of claim 13, where the inlet is parallel to a surface configured to engage a solenoid valve.

16. The cylinder head assembly of claim 13, where the inlet of the drainage passage is positioned adjacent to a vertical depression in a recess of a cam cover coupled to the cylinder head.

17. A cylinder head assembly comprising:

a cylinder head;

a cam cap coupled to the cylinder head including a solenoid valve port; and a cam cover coupled to the cylinder head and configured to seal a cam enclosure;

a recess extending into the cam cover and including a surface sloped towards an exhaust side of the cylinder head assembly;

a solenoid valve extending into the recess and the solenoid valve port; and a drainage passage including an inlet opening into the surface and an outlet positioned above an exhaust manifold outlet and extending through an exterior sidewall of the cylinder head, the drainage passage extending vertically downward through the cam cap and the cylinder head.

18. The cylinder head assembly of claim 17, where the exterior sidewall is on an exhaust side of the cylinder head assembly.

19. The cylinder head assembly of claim 17, where the inlet of the drainage passage is positioned adjacent to a vertical depression in the recess.

* * * * *